United States Patent [19]

Gernlein et al.

[11] 3,997,081

[45] Dec. 14, 1976

[54] APPARATUS FOR CONTROLLING THE OPERATION OF A PACKAGE FILLING DEVICE

[75] Inventors: Hermann Gernlein; Klaus Wieschollek, both of Ettlingen, Germany

[73] Assignee: Industrie-werke Karlsruhe Augsburg Aktiengesellschaft, Germany

[22] Filed: Feb. 2, 1976

[21] Appl. No.: 654,103

[30] Foreign Application Priority Data

Feb. 5, 1975 Germany ..... 7503337[U]

[52] U.S. Cl. ..... 222/76

[51] Int. Cl.[2] ..... F04B 41/06

[58] Field of Search ..... 92/20, 29, 15; 222/334, 222/333, 76, 309; 248/206 A

[56] References Cited

UNITED STATES PATENTS 3,606,098 9/1971 Genther ..... 222/309

*Primary Examiner*—Stanley H. Tollberg
*Attorney, Agent, or Firm*—McGlew and Tuttle

[57] ABSTRACT

An apparatus for controlling the operation of a package filling device, comprises a cylinder which has inlet and outlet means for the intake and discharge of a filling material into a package to be filled. A clamp piece is secured to a piston rod which is connected to the piston and a slider is movable along said piston rod below the clamp piece. A drive mechanism connected to the slider moves it upwardly and downwardly along said piston rod through a path to cause the slider to contact the clamp piece and to raise it along with the piston rod and the piston to deliver material from the cylinder. The rod is movable downwardly when the slide is caused to move downwardly by the drive mechanism and this causes the piston to draw in an additional charge of filling material. The operation of the piston rod is stopped easily by a magnetic device located so as to attract the clamp piece when it is at the top position of its travel and to thus hold the piston rod and the piston in a top position so that, upon subsequent operation of the driving mechanism to move the slide, there will be no movement of the piston. The mechanism may also include a lock for holding the piston in the inactive position.

11 Claims, 3 Drawing Figures

APPARATUS FOR CONTROLLING THE OPERATION OF A PACKAGE FILLING DEVICE

FIELD AND BACKGROUND OF THE INVENTION

This invention relates in general to the construction of devices for dosing materials into packages and, in particular, to a new and useful device for controlling the operation of a package or tube filling and sealing machine by controlling the movement of a reciprocating piston which effects the filling thereof.

DESCRIPTION OF THE PRIOR ART

When filling various elements particularly package tubes with a material, it is necessary to avoid undesired variations of the material properties, such as viscosity, separation, change into another state (milk-butter) of the filling material. Tube filling and sealing machines with means for automatically stopping of the piston which serves to dose the filling material have been known for a long time. A known embodiment of such a device includes a lever system which is locked during the filling process so that an angle lever which is included in the lever system moves with its nose over a belt to thus retain another lever of the system. The construction of the lever system includes various connecting links and levers which cannot yield and they become subject to a force stress which, in the prior art device, acts over a slotted lever and a number of additional mechanical members to the piston rod. A spring holds the system closed. If a tube to be filled with filling material fails to appear, a lifting magnet receives an electrical and attracts and disengages the angle lever. When the slotted lever moves down, the angle lever moves into its other end position so that it can swing down unhindered. With the angle lever attracted, an adjusting screw is swung under a clapping piece and fixes the piston rod in its upper dead center position.

Another embodiment of a device for controlling the operation of a filling machine includes a connection with a driver hub and a piston cam which is established by means of a displaceable wedge. When the machine is turned off, for example, in case of trouble, a lever system is swung under the action of an electromagnet into the path of the wedge. The lever system presses the wedge on the inside. The driving nose provided on the wedge is disengaged so that the shaft with the hub can pass through. A special brake system retains the piston cam at the same time. Both of the two mentioned prior art devices are used in practice though they do not represent the optimum in construction and design that can be achieved, as can be seen from the following analysis:

The first of the described embodiments has a relatively complicated lever system with a number of parts that wear out. Beyond that, this embodiment lacks the necessary switching accuracy and the piston cannot be stopped in a predetermined location. The overstroke of the piston results in the supply of a small amount of filling material which drops off on the nozzle and thus leads to the contamination of the tube receiving the filling material and of the machine itself. The known embodiment causes knocking noises during the disconnection and requires a relatively large space as well as high assembly and adjusting costs.

In the second of the above-described prior art embodiments, large forces appear in the operation mechanisms due to inertia, and in addition, the machine has a relatively complicated lever system. The jerky appearance of acceleration forces due to inertia also reduces the output of the machine and leads to undesired vibrations and noises. Such a known machine is not suitable for large piston forces and it requires a very large amount of space.

SUMMARY OF THE INVENTION

The present invention provides an improved machine which does not have the disadvantages of the prior art. In particular, the great expenditures inherent in the lever systems of the prior art are not required with the inventive arrangement. At the same time, the invention solves the additional problem of increasing the machine output in an adequate manner and the machine does not require a great amount of space.

In accordance with the invention, means for stopping the piston which doses the filling material comprises a magnet which is located so as to contact a clamping piece which is secured to the piston rod when the rod and the clamping piece are in the top dead center position. With the inventive arrangement, the piston is moved to its upward stroke by a slide member which is slidable on the piston rod and which engages beneath the clamp piece to raise the clamp piece with the piston rod and the piston during a filling stroke. When the slide piece is lowered, the piston rod drops by gravity to a starting position. A continuous lifting movement is imparted to the slide by means of a rocker arm which is driven through an eccentric or crank. The magnet for stopping the action of the piston is advantageously carried by the clamp piece and it cooperates with the slider. The magnet may be a permanent magnet or an electromagnet. The piston rod may be locked and held in a rest position by means of a stationary magnet which acts on an antipole rigidly connected with the piston rod and which may be designed as the clamping piece. The piston rod may be locked by means of a magnet rigidly connected with the rod and may be held in a rest position in such a way that it acts on a stationary antipole.

According to a further feature, the magnet transmitting the driving movement to the piston, and arranged on a separate guide bar, moves centrally in respect to the piston rod which is rigidly connected with the antipole.

The magnet may be rigidly connected with the piston rod and the antipole may be rigidly connected with a separate guide bar arranged centrally in respect to the piston rod. A mechanical lock may engage with the piston rod and support it in the top position in the event that the magnet is to be disconnected.

Accordingly, it is an object of the invention to provide a device for controlling the operation of a piston for regulating the discharge of material from a package filling discharge line of the associated cylinder and which includes a clamping sleeve connected to the rod of the piston and a slider which is movable along the piston by a drive mechanism through a path to move beneath the clamping sleeve and to raise the piston during each operating stroke and to move below the slide and permit the downfall of the piston on the return stroke and, wherein, there are means to stop the operation of the piston which includes a magnetic device located adjacent said clamp piece in the vicinity of the top position of movement of the clamp piece being capable of attracting and holding the clamping piece with the piston rod in an upper position so that, upon subsequent movement of the slider, the piston will not be moved.

A further object of the invention is to provide a control for operating the reciprocation of a piston in a filling device which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawings and descriptive matter in which there are illustrated preferred embodiments of the invention.

DESCRIPTION OF THE PREFERRED EMBODIMENTS

Figure 1:
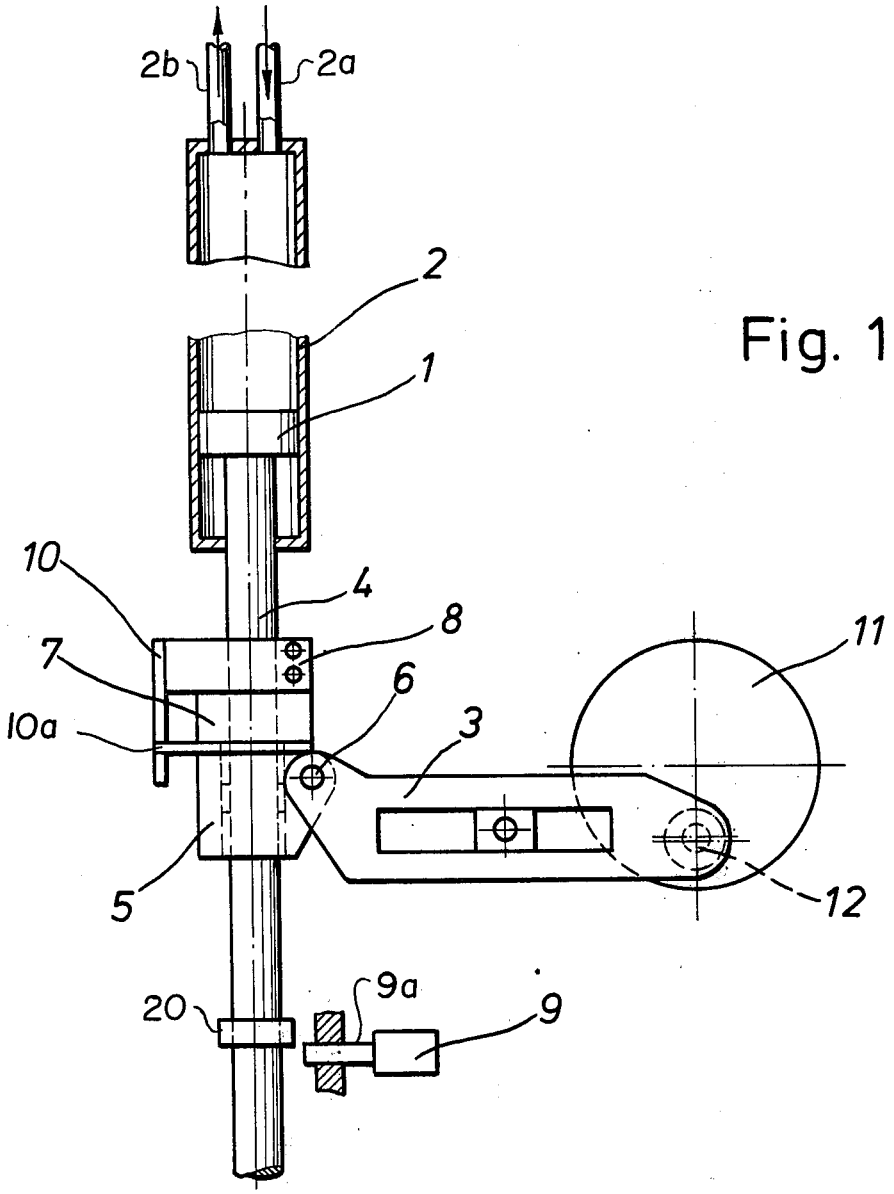
FIG. 1 is a somewhat schematic partial sectional view and partial elevational view of a drive mechanism for a piston and cylinder combination of a filling machine having means for stopping the operation of the piston, constructed in accordance with the invention.

Referring to the drawings in particular, the invention embodied therein in FIG. 1, comprises an apparatus for controlling the operation of a package filling device which includes an operating cyclinder 2 having inlet means 2*a* for the inflow of filling material into cylinder 2 during the downward movement of a piston 1 therein and outlet means 2*b* for the outflow of the filling material upon the movement of piston 1 upwardly in a discharge stroke.

In accordance with the invention, a piston rod 4 is connected to piston 1 and a clamping piece or clamping sleeve 8 is clamped to the rod 4 for movement therewith. A slide 5 which is slidable along rod 4 is driven by a drive mechanism which includes a cam system or crank 11 which is rotatable to move a pivot bolt connection 12 to a rocker arm 3 which is connected at its opposite end through a bolt or pivot 6 to slide 5. The rotation of cam 11 effects an upward and downward movement of slide 5 along rod 4 and the upward movement of the slide against the clamp piece 8 causes a lifting of the clamp piece with the piston rod and piston 1 to cause it to move on a filling stroke to discharge material through the outlet means 2*b*.

In accordance with a feature of the invention, means are provided for stopping the operation of the piston rod and the piston 1 so that no further material will be dosed into a package. The means includes magnet means, such as a magnet 7 for attracting and holding the clamp piece 8 and the piston rod in a top position of travel so that, upon subsequent downward movement of slide 5, piston rod 4 will not drop along with the rod but will be retained in an upper position. In the embodiment of FIG. 1, magnet 7 is secured to the clamp piece 8, but it may also be carried on the slide 5. The piston is stopped by disconnecting magnet 7 when it is in its upper position so that the slider can swing down without piston 1. The piston is retained in its upper end position, together with the piston rod 4, by any suitable means, for example, such as a lock mechanism 9, which includes a bolt 9*a* which may be slidable below a locking shoulder 20 to hold the rod 4 in an elevated position.

A guide 10 carried by clamping piece 8 engages with an element 10*a* and ensures that the rod does not rotate relative to the slide 5.

Figure 2:
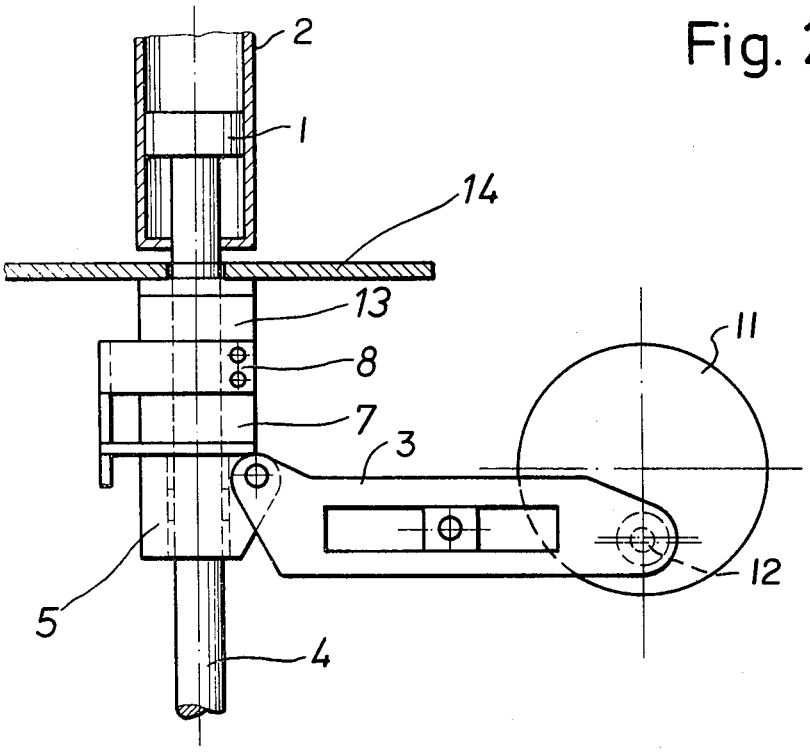
FIG. 2 is a view similar to FIG. 1 of another embodiment of the invention.

In FIG. 2, locking of the piston 4 in an upper position may be accomplished by a magnetic device in the form of a separate magnet 13, for example, which is carried by a machine frame part 14 in a position to magnetically attract and hold either the clamping piece 8 which may be manufactured as an antipole or a magnetically attractable material or it may attract the magnet 7 carried on the clamping piece 8 below the bottom side thereof. If magnet 13 is energized in the upper dead position of magnet 7 or clamp piece 8 alone, piston 4 will be retained in the upper position and the driving rocker arm can swing down with the slider 5 without causing any further movement of the piston when it moves back upwardly again.

Figure 3:
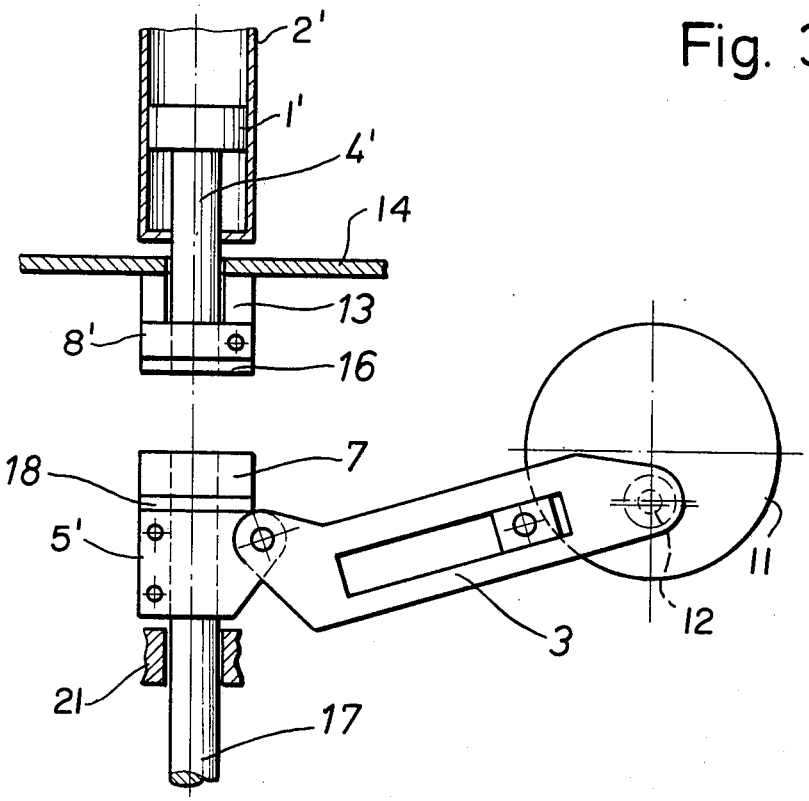
FIG. 3 is a view similar to FIG. 1 of still another embodiment of the invention.

In the embodiment of FIG. 3, the piston rod 4′ is foreshortened and is provided with a clamping sleeve 8′ which carries an antipole 16 which is attracted by a magnet 13 carried by a machine frame part 14. When magnet 13 is energized, the clamping piece 8′, with piston rod 4′, will be held in an uppermost position. When it is de-energized, it will fall downwardly against a magnet 7 which may be made so as to magnetically attract the antipole 16 and associate the piston rod 4′ with a guide bar 17 which carries both the magnet 7 and the antipole 18 and a slide 5′. In the position of magnet 7 shown in FIG. 3, magnet 7 is deenergized. If filling material is to be dosed again, the magnet 7 is energized when it is in its upper dead center position and, at the same time, magnet 13 is de-energized so that magnet 7 will be attracted to antipole 16 and cause piston rod 4′ to move with the slide 5′ and the guide bar 17 which is guided in a guideway 21.

The invention provides many advantages:

By completely maintaining all operating functions and by eliminating the circumferential lever system of the prior art, the invention is a relatively simple construction, both in design and method of operation and is less susceptible to trouble. The invention also avoids any problem of the undesired and hitherto unavoidable overstroke of the piston and an overdosing. The operating parts are relatively few and the wear between the parts is reduced considerably over that of the prior art devices. The space requirements for the device is much less than the known devices and the output of the device may be increased materially over the known prior art devices.

While specific embodiments of the invention have been shown and described in detail to illustrate the application of the principles of the invention, it will be understood that the invention may be embodied otherwise without departing from such principles.

What is claimed is:

1. An apparatus for controlling the operation of a package filling device, comprising a cylinder having inlet means and discharge means for respectively taking in filling material and for discharging the filling material into a package to be filled, a piston rod connected to said piston, a clamp piece affixed to said piston rod, a slider slidable on said piston rod below said clamp piece, a drive mechanism connected to said slider to move it upwardly and downwardly on said piston rod through a path to cause said slider to contact said clamp piece and to raise it along with said piston rod and said piston to discharge material from said cylinder, said rod being movable downwardly when said slider is moved downwardly by said drive mechanism to cause downward movement of said piston and to draw in an additional charge of filling material, and means to stop the operation of said piston rod and piston including a magnetic device located adjacent said clamp piece in the top position of travel of said piston acting to attract and hold said clamp piece in its uppermost position of travel, whereby, it will not be moved upwardly by said slider during the next upward movement of travel caused by said drive means.

2. An apparatus according to claim 1, including a machine frame part, said magnetic device comprising a magnet carried by said frame part at a location in the uppermost position of said slider.

3. An apparatus according to claim 2, including a second magnet carried by a clamp piece between said clamp piece and said slider and being attractable to said magnet on said machine part when said clamp piece is in an uppermost position.

4. An apparatus according to claim 2, including a second magnet located between said clamp piece and said slider for selective attraction to said slider and to said clamp piece.

5. An apparatus for controlling the operation of a package filling device, comprising a cylinder having inlet means and for respectively taking in a filling material and for discharging filling material into a package to be filled, a piston rod connected to said piston, a clamp piece affixed to said piston rod, a slider slidable on said piston rod below said clamp piece, a drive mechanism connected to said slider to move said slider upwardly and downwardly on said piston rod, magnetic means between said clamp piece and said slider coupling said slider and said clamp piece so that upward and downward movement of said slider effects upward and downward movement of said piston, said magnet means being releasable to uncouple said slider from said clamp piece to permit said slider to drop, and locking means engageable with said piston rod for holding it in a position at which said magnet means is disconnected.

6. An apparatus according to claim 5, wherein said magnet means is connected with said clamping piece and cooperates with said slider.

7. An apparatus according to claim 5, wherein said locking means comprises a stationary magnet, said piston rod having an antipole portion thereon attractable by said magnet to hold it in a locked position.

8. An apparatus according to claim 7, wherein said clamping piece forms an antipole engageable with said permanent magnet, said clamping piece being affixed to said piston rod.

9. An apparatus according to claim 5, including a guide bar forming a continuation of said piston rod, said slider being slidable on said guide bar, said piston rod being foreshortened and terminating at said clamping piece, said locking means comprising a magnet holding said clamping piece and said piston in an uppermost position and permitting separation of said slider with said guide bar from said piston rod.

10. An apparatus for controlling the operation of a package filling device, comprising a cylinder having inlet means and discharge means for respectively taking in filling material and for discharging filling material into a package to be filled, a piston rod connected to said piston, a first clamping piece connected to said piston rod, first magnet means for attracting said clamping piece and holding it in an uppermost position, with said piston rod and said piston, a guide rod forming a continuation of said piston rod at a spaced location from an end thereof, a slider extending around said guide rod, second magnet means affixed to said guide rod, means for de-energizing said first magnet means to release said piston rod and for energizing said second magnet means when said slider is in a top dead center position to engage said second magnet means with said clamping piece and said piston rod to cause movement of said piston rod with said slider and said guide rod, and a drive mechanism connected to said slider to move it upwardly and downwardly.

11. An apparatus according to claim 10, including an antipole formed on said clamping piece, said antipole being attractable to said first magnet means, second magnet means being carried by said slider, said second magnet means being attracted to said antipole upon release of said first magnet means.

* * * * *